US010033099B2

(12) United States Patent
Simon et al.

(10) Patent No.: US 10,033,099 B2
(45) Date of Patent: Jul. 24, 2018

(54) DUAL-POLARIZED, DUAL-BAND, COMPACT BEAM FORMING NETWORK

(71) Applicant: Space Systems/Loral, LLC, Palo Alto, CA (US)

(72) Inventors: Peter S. Simon, Camarillo, CA (US); Michael Aliamus, San Jose, CA (US); Behzad Tavassoli Hozouri, Sunnyvale, CA (US); Robert Jones, Union City, CA (US); Michael Grall, Santa Cruz, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 268 days.

(21) Appl. No.: 14/968,725

(22) Filed: Dec. 14, 2015

(65) Prior Publication Data

US 2017/0170561 A1 Jun. 15, 2017

(51) Int. Cl.
*H01Q 3/22* (2006.01)
*H01Q 5/28* (2015.01)
(Continued)

(52) U.S. Cl.
CPC ..... *H01Q 5/28* (2015.01); *H01P 5/024* (2013.01); *H01P 5/12* (2013.01); *H01Q 1/288* (2013.01);
(Continued)

(58) Field of Classification Search
CPC ..... H01Q 3/00; H01Q 3/36; H01Q 1/288; H01Q 19/17; H01Q 21/064; H01Q 21/005;
(Continued)

(56) References Cited

U.S. PATENT DOCUMENTS 2,983,920 A 5/1961 Rearwin
4,839,663 A 6/1989 Kurtz
(Continued)

FOREIGN PATENT DOCUMENTS

CN 204 315 732 U 5/2015
JP H05 48323 A 2/1993
(Continued)

OTHER PUBLICATIONS

International Search Report and Written Opinion for PCT/US2016/063182 dated Feb. 20, 2017.

*Primary Examiner* — Harry K Liu
(74) *Attorney, Agent, or Firm* — Weaver Austin Villeneuve & Sampson LLP

(57) ABSTRACT

A spacecraft communications payload includes a beam forming network (BFN), wherein the BFN includes a first feed waveguide and a first set of branch waveguides, each branch waveguide in the first set operating in a frequency band having a characteristic waveguide wavelength $\lambda_{g1}$. A proximal portion of the first set of branch waveguides is communicatively coupled with the first feed waveguide. A distal portion of the first set of branch waveguides is communicatively coupled by way of an array of slots with a plurality of radiating elements. A separation distance between adjacent slots in the array is approximately equal to $\lambda_g$, and the array of slots is configured as a honeycomb-like triaxial lattice. In some implementations, a compact BFN may be configured to simultaneously operate at two different polarizations ("dual-polarized") and/or frequency bands ("dual-band").

20 Claims, 6 Drawing Sheets

(51) Int. Cl.

| | |
|---|---|
| ***H01Q 3/36*** | (2006.01) |
| ***H01Q 21/00*** | (2006.01) |
| ***H01P 5/02*** | (2006.01) |
| ***H01P 5/12*** | (2006.01) |
| ***H01Q 1/28*** | (2006.01) |
| ***H01Q 19/17*** | (2006.01) |
| ***H01Q 21/06*** | (2006.01) |
| ***H01Q 25/00*** | (2006.01) |
| ***H01Q 5/45*** | (2015.01) |

(52) U.S. Cl.
CPC ..... *H01Q 3/36* (2013.01); *H01Q 5/45* (2015.01); *H01Q 19/17* (2013.01); *H01Q 21/005* (2013.01); *H01Q 21/064* (2013.01); *H01Q 25/001* (2013.01)

(58) Field of Classification Search
CPC ..... H01Q 25/001; H01Q 5/28; H01Q 5/45; H01P 5/024
USPC ..... 342/371
See application file for complete search history.

(56) References Cited

U.S. PATENT DOCUMENTS

| | | | | |
|---|---|---|---|---|
| 6,127,985 | A | 10/2000 | Guler | |
| 6,366,244 | B1 | 4/2002 | Fernandes | |
| 6,476,772 | B1 | 11/2002 | Smith et al. | |
| 8,149,177 | B1 * | 4/2012 | Callus | H01Q 1/286 343/705 |
| 9,077,083 | B1 * | 7/2015 | Freeman | H01Q 21/24 |
| 2002/0081969 | A1 | 6/2002 | Chang et al. | |
| 2008/0129453 | A1 * | 6/2008 | Shanks | G06K 7/0008 340/10.1 |
| 2012/0013962 | A1 * | 1/2012 | Subbaraman | B82Y 20/00 359/15 |
| 2013/0099990 | A1 * | 4/2013 | Bresciani | H01Q 3/46 343/834 |

FOREIGN PATENT DOCUMENTS

| | | | |
|---|---|---|---|
| JP | 2001/111472 | A | 4/2001 |
| WO | WO 03/047033 | A1 | 6/2003 |

* cited by examiner

DUAL-POLARIZED, DUAL-BAND, COMPACT BEAM FORMING NETWORK

TECHNICAL FIELD

This invention relates generally to a spacecraft, and more particularly to a spacecraft communications payload including a compact beam forming network.

BACKGROUND OF THE INVENTION

The assignee of the present invention designs and manufactures spacecraft or satellites for operation in, for example, geosynchronous and low earth orbits. Such communication satellites carry communication systems and antennas that are used to communicate with ground-based communication devices. An antenna reflector may be illuminated by an array of radiating elements, such as feed horns, that are coupled with a beamforming network (BFN). The BFN may include a waveguide slot array such as described in U.S. Pat. No. 6,476,772, assigned to the assignee of the present invention, and hereby incorporated in its entirety into the present application. Such a waveguide slot array may include a set of parallel waveguides having broad walls that include slots so as to form a two dimensional planar array of slots. The slots disposed on each parallel waveguide are spaced at half-waveguide wavelength ($\lambda_g/2$) intervals along the waveguide length and adjacent slots are positioned on opposite sides of the centerline of the waveguide.

Improvements in the BFN that permit dual polarized and/or dual band operation in a more compact structure are desirable.

SUMMARY

The present disclosure contemplates a compact beamforming network (BFN) including a waveguide slot array for use in satellite applications.

According to some implementation, a spacecraft communications payload includes a beam forming network (BFN). The BFN includes a first feed waveguide and a first set of branch waveguides, each branch waveguide in the first set operating in a frequency band having a characteristic waveguide wavelength $\lambda_{g1}$. A proximal portion of the first set of branch waveguides is communicatively coupled with the first feed waveguide. A distal portion of the first set of branch waveguides is communicatively coupled by way of an array of slots with a plurality of radiating elements. A separation distance between adjacent slots in the array is approximately equal to $\lambda_g$, and the array of slots is configured as a honeycomb-like triaxial lattice.

In some examples, a broadwall of each branch waveguide may include a distal surface and a respective portion of the array of slots is disposed on the distal surface.

In some examples, the BFN may include a second feed waveguide and a second set of branch waveguides, each branch waveguide in the second set operating in a frequency band having a characteristic waveguide wavelength $\lambda_{g2}$, where a proximal portion of the second set of branch waveguides is communicatively coupled with the second feed waveguide, the first set of branch waveguides is not communicatively coupled with the second feed waveguide, the second set of branch waveguides is not communicatively coupled with the first feed waveguide, the array of slots includes a plurality of slot pairs, each slot pair including a respective first slot associated with the first set of branch waveguides and a respective second slot associated with the second set of branch waveguides, and each radiating element is communicatively coupled with a respective one of the plurality of slot pair. In some examples, $\lambda_{g1}$ may be approximately equal $\lambda_{g2}$. In some examples, the first feed waveguide and the first set of branch waveguides is configured to operate at a first center frequency and a first polarization scheme, and the second feed waveguide and the second set of branch waveguides may be configured to operate at a second center frequency and a second polarization scheme.

In some examples, the first polarization scheme may be different from the second polarization scheme. In some examples, the first center frequency is different from the second center frequency.

In some examples, respective pairs of branch waveguides of the first set of branch waveguides and the second set of branch waveguides may be interlaced. In some examples, one or both of a respective orthomode transducer and a respective pair of phase shifters may be disposed between each radiating element and each slot pair. In some examples, the first set of branch waveguides is configured to operate at a downlink frequency band and the second set of branch waveguides is configured operate at an uplink frequency band.

According to some implementations, a system includes a spacecraft communications payload including a receiver, a transmitter, and a beam forming network (BFN). The BFN includes a first feed waveguide and a first set of branch waveguides, each branch waveguide in the first set operating in a frequency band having a characteristic waveguide wavelength $\lambda_{g1}$. A proximal portion of the first set of branch waveguides is communicatively coupled with the first feed waveguide, the first feed waveguide being communicatively coupled with one or both of the receiver and the transmitter. A distal portion of the first set of branch waveguides is communicatively coupled by way of an array of slots with a plurality of radiating elements. A separation distance between adjacent slots in the array is approximately equal to $\lambda_g$, and the array of slots is configured as a honeycomb-like triaxial lattice.

In some examples, the first feed waveguide and the first set of branch waveguides may be configured to operate at a first center frequency and a first polarization scheme and the second feed waveguide and the second set of branch waveguides may be configured to operate at a second center frequency and a second polarization scheme.

In some implementations, an apparatus includes a waveguide slot array including a first feed waveguide and a first set of branch waveguides, each branch waveguide in the first set operating in a frequency band having a characteristic waveguide wavelength $\lambda_{g1}$. A proximal portion of the first set of branch waveguides is communicatively coupled with the first feed waveguide. A distal portion of the first set of branch waveguides is communicatively coupled by way of an array of slots with a plurality of radiating elements. A separation distance between adjacent slots in the array is approximately equal to $\lambda_g$, and the array of slots is configured as a honeycomb-like triaxial lattice.

BRIEF DESCRIPTION OF THE DRAWINGS

Features of the invention are more fully disclosed in the following detailed description of the preferred embodiments, reference being had to the accompanying drawings, in which.

Figure 1:
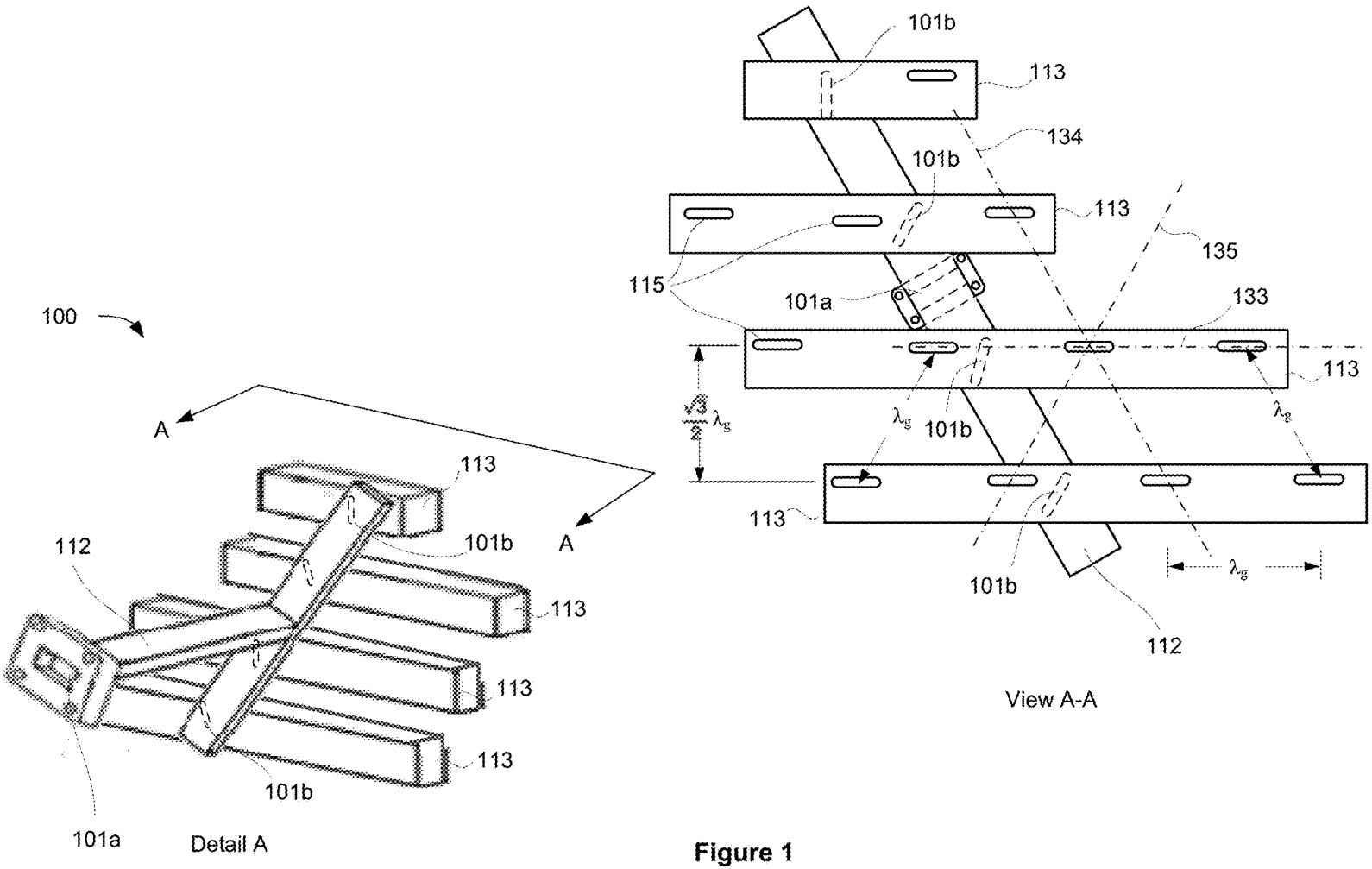
FIG. 1 illustrates a waveguide slot array for a beamforming network (BFN), according to an implementation.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. It will be understood that although the terms "first" and "second" are used herein to describe various elements, these elements should not be limited by these terms. These terms are used only to distinguish one element from another element. As used herein, the term "and/or" includes any and all combinations of one or more of the associated listed items. The symbol "/" is also used as a shorthand notation for "and/or".

The present disclosure contemplates a compact beamforming network (BFN) including a waveguide slot array for use in satellite applications, where weight and mass are at a premium. In some implementations, the BFN may be configured to simultaneously operate at two different polarizations ("dual-polarized") and/or frequency bands ("dual-band"). In some implementations, the waveguide slot array may include slotted waveguide arrays with the slots spaced at one guide wavelength ($\lambda_g$) intervals as opposed to the $\lambda_g/2$ intervals of the prior art. In some implementations the waveguide slot array may be communicatively coupled with radiating elements such as circular feed horns.

FIG. 1 illustrates a waveguide slot array for a BFN, according to an implementation. Detail A of FIG. 1 depicts a perspective view of a proximal side of the waveguide slot array 100. The waveguide slot array 100 includes a first feed waveguide 112 communicatively coupled with a first set of branch waveguides 113. The first feed waveguide 112 may be communicatively coupled with a transmitter and/or a receiver of a spacecraft communications payload (omitted for clarity of illustration) by way of a proximal port 101*a*. The first feed waveguide 112 may be communicatively coupled with each branch waveguide 113 of the first set of branch waveguides by way of a plurality of series slots 101*b*. The branch waveguides 113 each include a distal surface including at least one shunt slot 115. The branch waveguides 113 may each be configured to have a substantially similar first characteristic guide wavelength $\lambda_g$.

The first set of branch waveguides 113 may be disposed such that the shunt slots 115 form a 2-D array. Advantageously, the array of slots is configured such that a distance between any two adjacent slots is approximately equal to $\lambda_g$. In addition, as may be observed in View A-A, the shunt slots 115 may be arranged in a 2-D array characterized by three axes, 133, 134, and 135. As a result, the shunt slots 115 are arranged in a honeycomb-like triaxial lattice such that any slot, other than an edge slot, is adjacent to six neighboring slots approximately located at the vertices of a regular hexagon. The arrangement may be referred to as a triaxial lattice because each of three axes, axis 133, axis 134, and axis 135, defines a respective angle along which a set of adjacent shunt slots 115 are disposed. In the illustrated implementation, for example, lines of adjacent slots 115 are illustrated as being disposed (1) in the horizontal direction, parallel to axis 133; (2) in a direction parallel to axis 134, that is 60° clockwise from axis 133; and (3) in a direction parallel to axis 135 that is 60° counter clockwise from axis 133.

Figure 2:
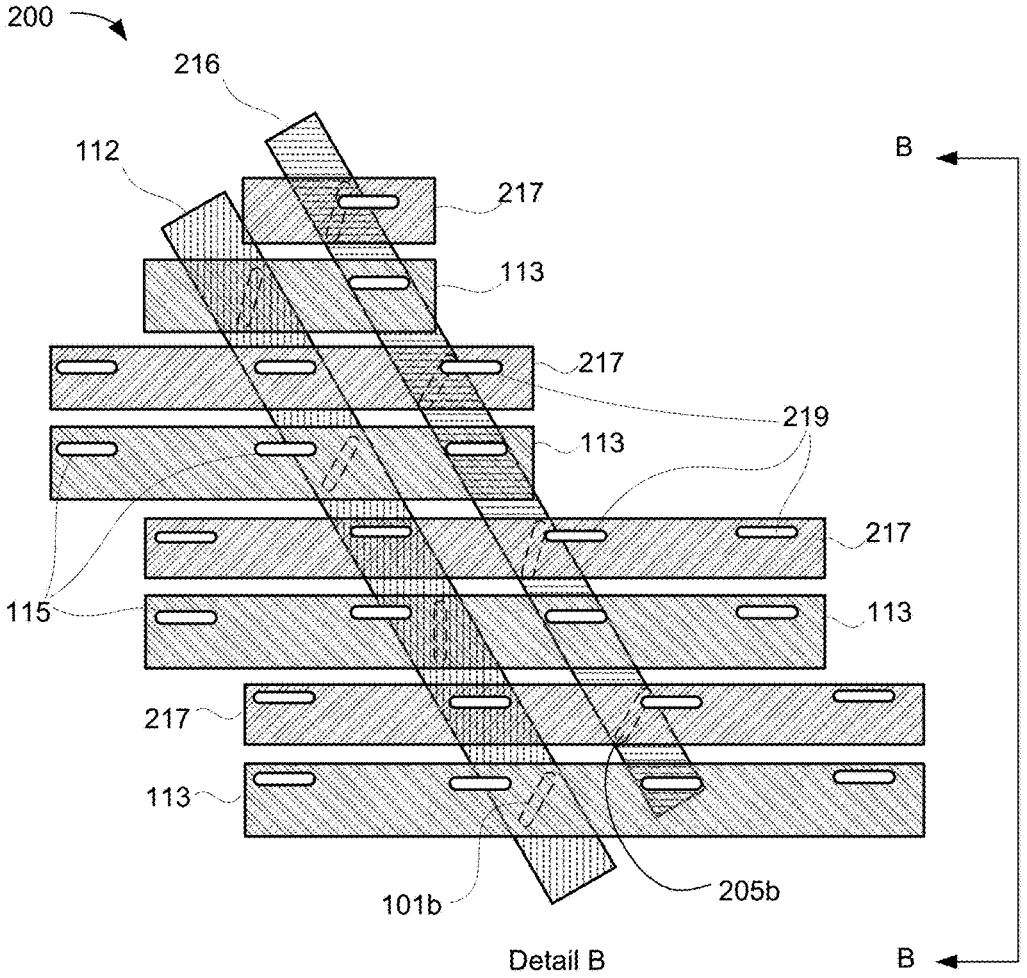
FIG. 2 illustrates a waveguide slot array for a BFN, according to another implementation.
Figure 2:
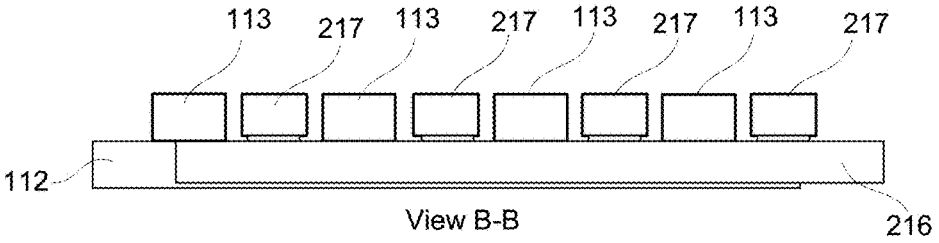

FIG. 2 illustrates a waveguide slot array for a BFN, according to another implementation. The waveguide slot array 200 includes the first set of branch waveguides 113 and the first feed waveguide 112 of the waveguide slot array 100. In addition, the waveguide slot array 200 includes a second feed waveguide 216 and a second set of branch waveguides 217. The second feed waveguide 216 may be coupled with a transmitter and/or a receiver of the spacecraft communications payload by way of a proximal port (not illustrated). The second feed waveguide 216 may be communicatively coupled with each branch waveguide 217 of the second set of branch waveguides by way of a plurality of series slots 205*b*. The branch waveguides 217 each include a distal surface including at least one slot 219. The branch waveguides 217 may each be configured to have a substantially similar characteristic second guide wavelength $\lambda_{g(2)}$, Advantageously, cross-sectional dimensions of the branch waveguides 113 and the branch waveguides 217 may be selected so as to provide that $\lambda_{g(1)}$ approximately equal to $\lambda_{g(2)}$. In some implementations, the branch waveguides 113 and the branch waveguides 217 may be configured to operate in substantially similar frequency bands, in which case the cross-sectional dimensions of the branch waveguides 113 and the branch waveguides 217 may be approximately equal. In other implementations, the branch waveguides 113 and the branch waveguides 217 may be configured to operate at a substantially different center frequency, and correspondingly different cross-sectional dimensions may be selected so that an electrical length between slots of the branch waveguides 113 as well as $\lambda_{g(1)}$ is approximately the same as an electrical length between slots of the branch waveguides 217 and $\lambda_{g(2)}$.

In some implementations the first feed waveguide 112 and the waveguides 113 may be configured to operate at a first center frequency and a first polarization scheme, while the second feed waveguide 216 and the branch waveguides 217 are configured to operate at a second center frequency and a second polarization scheme. The first polarization scheme may or may not be different from the second polarization scheme. Likewise, the first center frequency and the second center frequency may or may not be different. In the illustrated implementation, branch waveguides 113 and 217 are interlaced such that each branch waveguide 113 is adjacent only to a branch waveguide 217, and vice versa.

Figure 3:
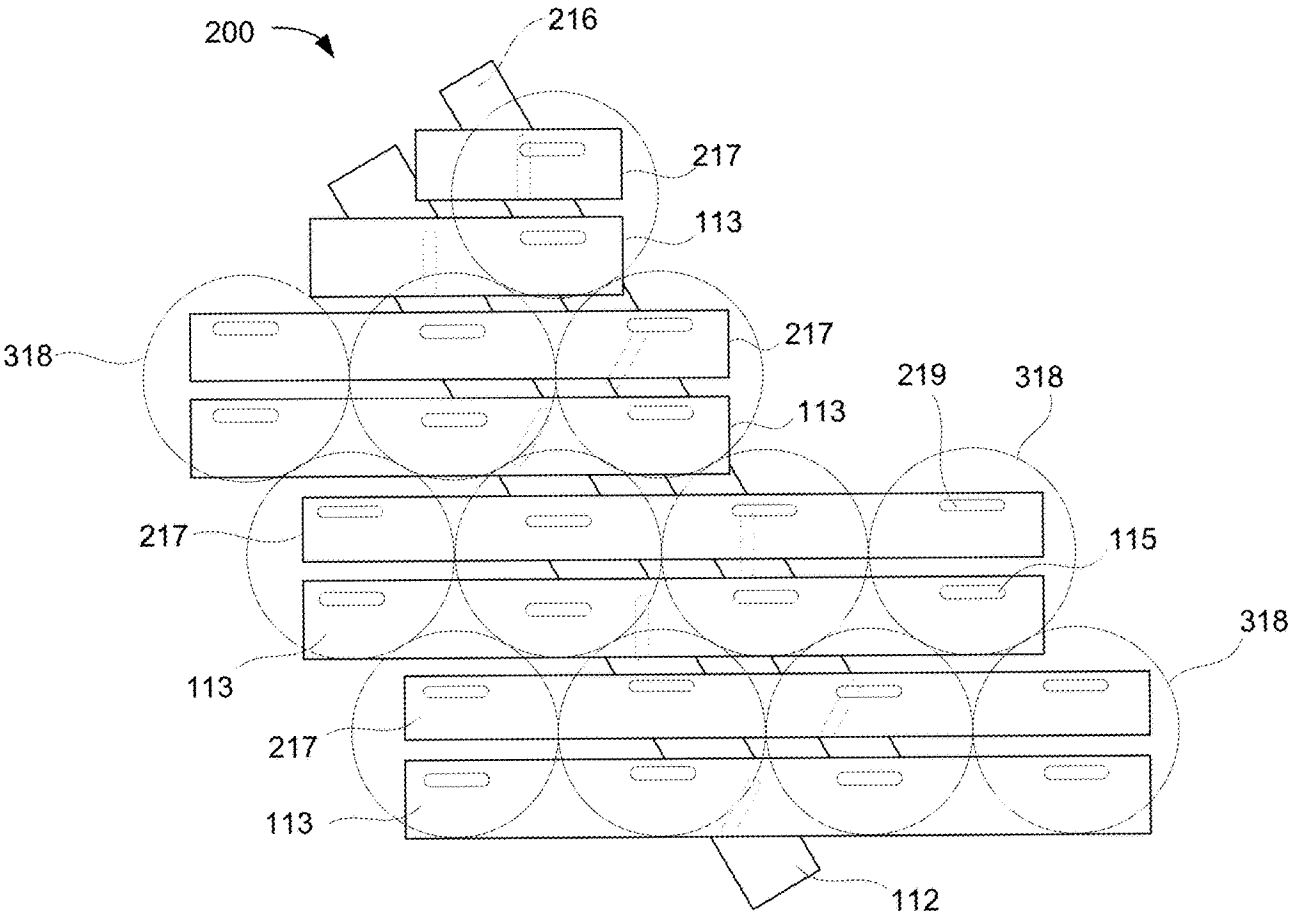
FIG. 3 illustrates additional features of the waveguide slot array, coupled with radiating elements, according to another implementation.

Referring now to FIG. 3, a plurality of radiating elements 318 are shown disposed with respect to the waveguide slot array 200 such that each radiating element 318 is communicatively coupled with both a respective branch waveguide 113 and a respective branch waveguide 217 by way of a respective pair of slots. Each respective pair of slots includes one slot 115 and one slot 219. In some implementations, the radiating elements 318 may be horns, for example.

The radiating elements 318 may be coupled with the waveguide slot array 200 by a waveguide lens arrangement that includes an array of rectangular waveguides disposed adjacent to the waveguide slot array 200, as described in U.S. Pat. No. 6,476,772, for example. The phase of each radiating waveguide of the waveguide lens may be controlled to achieve radiation pattern shaping. The waveguide lens arrangement may likewise include an array of phase shifters and orthomode transducers (not illustrated).

In the illustrated example, provision of a separation distance $\lambda_g$ between any two adjacent slots permits the radiating elements 318 to have a maximum outer diameter substantially larger than the width of any branch waveguide while avoiding mechanical interference. Mutual electrical coupling between radiating elements is likewise reduced, with a result that performance prediction and design processes are simplified. The triaxial lattice arrangement, advantageously, allows the radiating element to be closely packed, i.e., efficiently use the available area.

The disclosed techniques provide that each radiating element 318 may be communicatively coupled with two separate and independent branch waveguides. In some implementations, a given radiating element may be communicatively coupled with both a receiver by way of the first branch waveguide 113 and a transmitter by way of the second branch waveguide 217, for example. Similarly, in some implementations, a given radiating element may be operable both at receive (uplink) frequency band (e.g., 6 GHz, 14 GHz, or 30 GHz) and at a transmit (downlink) frequency band (e.g., 4 GHz, 12 GHz, or 20 GHz). Moreover, a given radiating element may be operable at both a first polarization scheme and a second, different, polarization scheme. In view of the above mentioned features, the disclosed techniques may be said to relate to a dual polarized, dual-band compact beam forming network.

Figure 4:
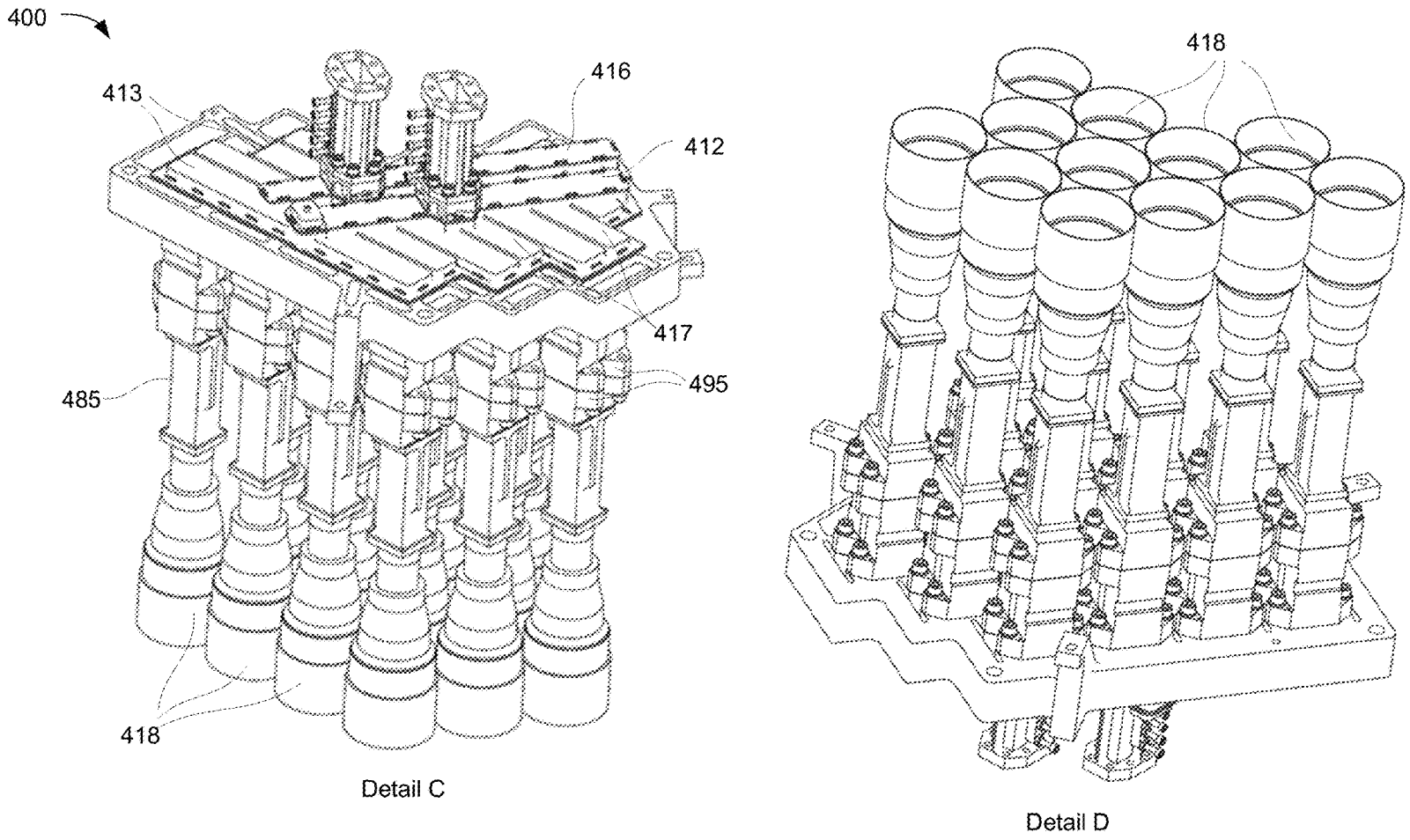
FIG. 4 illustrates a BFN in accordance with a further implementation.

FIG. 4 illustrates a beam forming network in accordance with an implementation. The arrangement may also be referred to as a pair of interlaced resonant matrix (ReMix) beamforming networks. The beamforming network 400 is shown in perspective views. A first perspective view faces, in Detail C, a proximal portion of the beamforming network 400. A second perspective view faces, in detail D, a distal portion of the beamforming network 400. The beamforming network 400 includes a plurality of radiating elements 418, each radiating element 418 being configured, in the illustrated example, as a horn. It will be appreciated that beamforming network 400 may be configured as a feed array, or a portion of a feed array, for an antenna reflector (not illustrated). Advantageously the radiating elements 418 are arranged in a compact triaxial lattice, with minimal gaps between adjacent radiating elements. Each radiating element 418 may be communicatively coupled by way of a respective pair of slots (not illustrated) to a respective branch waveguide 413 and a respective branch waveguide 417. The branch waveguides 413 may be communicatively coupled with a feed waveguide 412. The branch waveguides 417 may be communicatively coupled with a feed waveguide 416. In the illustrated implementation, an orthomode transducer 485 and a pair of phase shifters 495 is disposed between each radiating element 418 and the respective branch waveguides 413 and 417.

Figure 5:
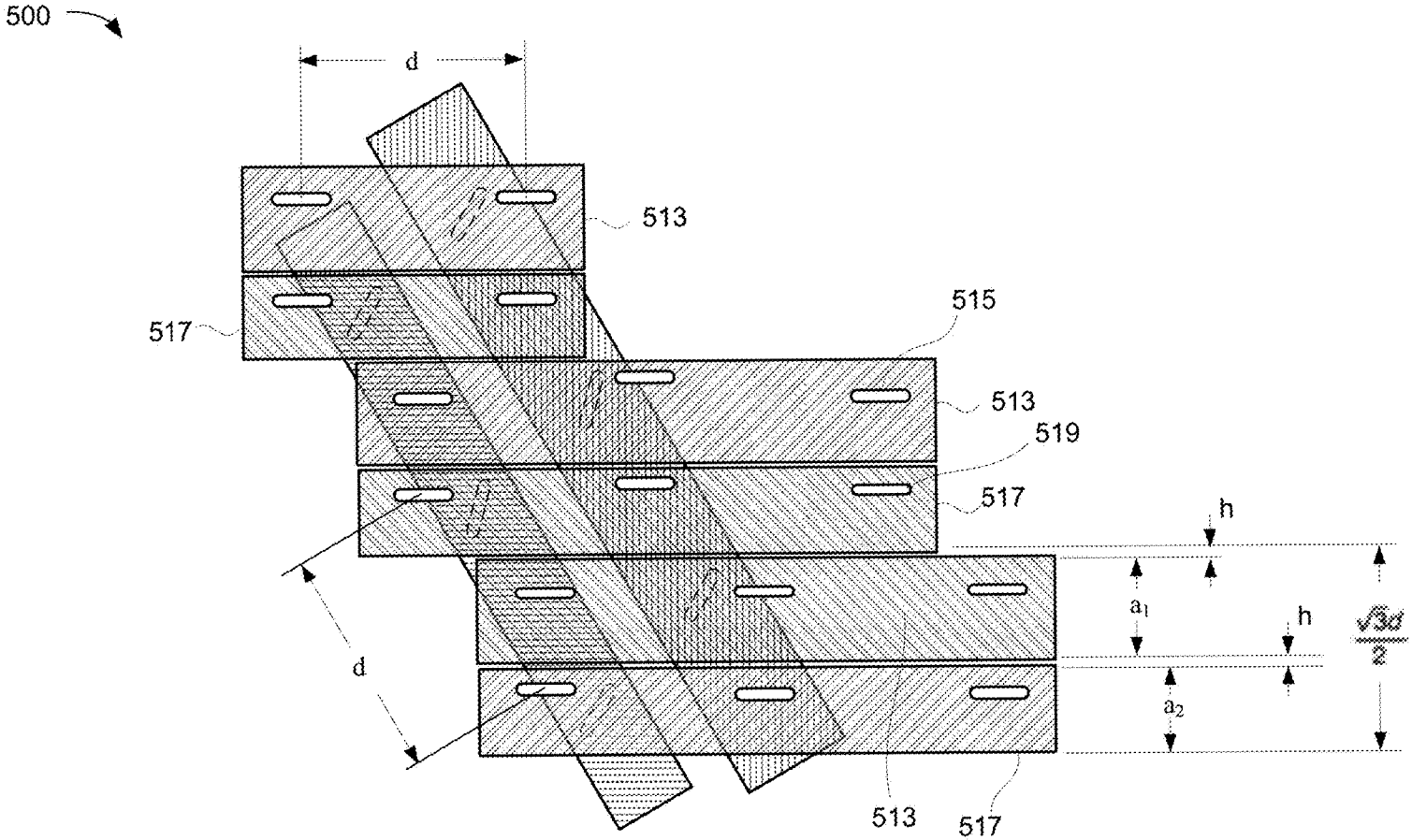
FIG. 5 illustrates features of a slot array for dual frequency ReMix BFNs configured to accommodate eight radiating elements.

The open implementations illustrated in FIGS. 1 through 4 contemplated an arrangement of twelve radiating elements. A larger or smaller number of radiating elements are also within the contemplation of the present disclosure. For example, FIG. 5 illustrates features of a slot array for dual frequency ReMix beamforming networks configured to accommodate eight radiating elements. In the illustrated example, a first plurality of branch waveguides 513 and a second plurality of branch waveguides 517 are interlaced so as to provide that a plurality of slot pairs are arranged in a triaxial lattice, each slot pair including a slot 515 disposed on a branch waveguide 513, and a slot 519 disposed on a branch waveguide 517. A first center frequency ($f_1$) at which the first plurality of branch waveguides 513 are configured to operate and a second center frequency ($f_2$) at which the second plurality of branch waveguides 517 are configured operate may in general be different. In some implementations, for example, the first plurality of branch waveguides 513 may be configured to operate within a transmit (downlink) frequency band (e.g., 4 GHz, 12 GHz, or 20 GHz), while the second plurality of branch waveguides 517 may be configured to operate within a receive (uplink) frequency band (e.g., 6 GHz, 14 GHz, or 30 GHz). It is desired to interlace the first plurality of branch waveguides 513 and the second plurality of branch waveguides 517 such that they excite a common triaxial lattice array of radiating elements with element centers spacing 'd'. Accordingly, where each first branch waveguide 513 has a broad wall dimension $a_1$ and each second branch waveguide 517 has a broad wall dimension $a_2$ and the waveguide interiors are separated by a wall thickness (including a separation gap, if any) of minimum dimension 'h', the following relationship determines the minimum allowable inter-element separation d that is possible without mechanical interference:

$$a_1+a_2+2h<\sqrt{3}d/2.$$

For both the first branch waveguide 513 and the second branch waveguide 517, a relationship between the guide wavelength $\lambda_g$ and the free space wavelength $\lambda$ is known to be:

$$\lambda_g = \frac{\lambda}{\sqrt{1-[\lambda/(2a)]^2}}.$$

Accordingly, in some implementations, the respective broad wall dimensions $a_1$ and $a_2$ may be chosen such that $d=\lambda_{g1}=\lambda_{g2}$, where $\lambda_{g1}$ and $\lambda_{g2}$ are characteristic waveguide wavelengths corresponding respectively to center frequency $f_1$ (with a corresponding free space wavelength $\lambda_1$) at which the first plurality of branch waveguides 513 are configured to operate and center frequency $f_2$ (with a corresponding free space wavelength $\lambda_2$) at which the second plurality of branch waveguides 517 are configured to operate. That is, by satisfying the relationships:

$$a_1 = \frac{\lambda_1}{2\sqrt{1-[\lambda_1/(d)]^2}} \text{ and } a_2 = \frac{\lambda_2}{2\sqrt{1-[\lambda_2/(d)]^2}}$$

simultaneously with the inequality given above, an approximately identical slot separation distance $d=\lambda_{g1}=\lambda_{g2}$ may be provided for both of the first branch waveguides 513 and the second branch waveguides 517, while avoiding any mechanical interference between the two sets of branch waveguides.

Figure 6:
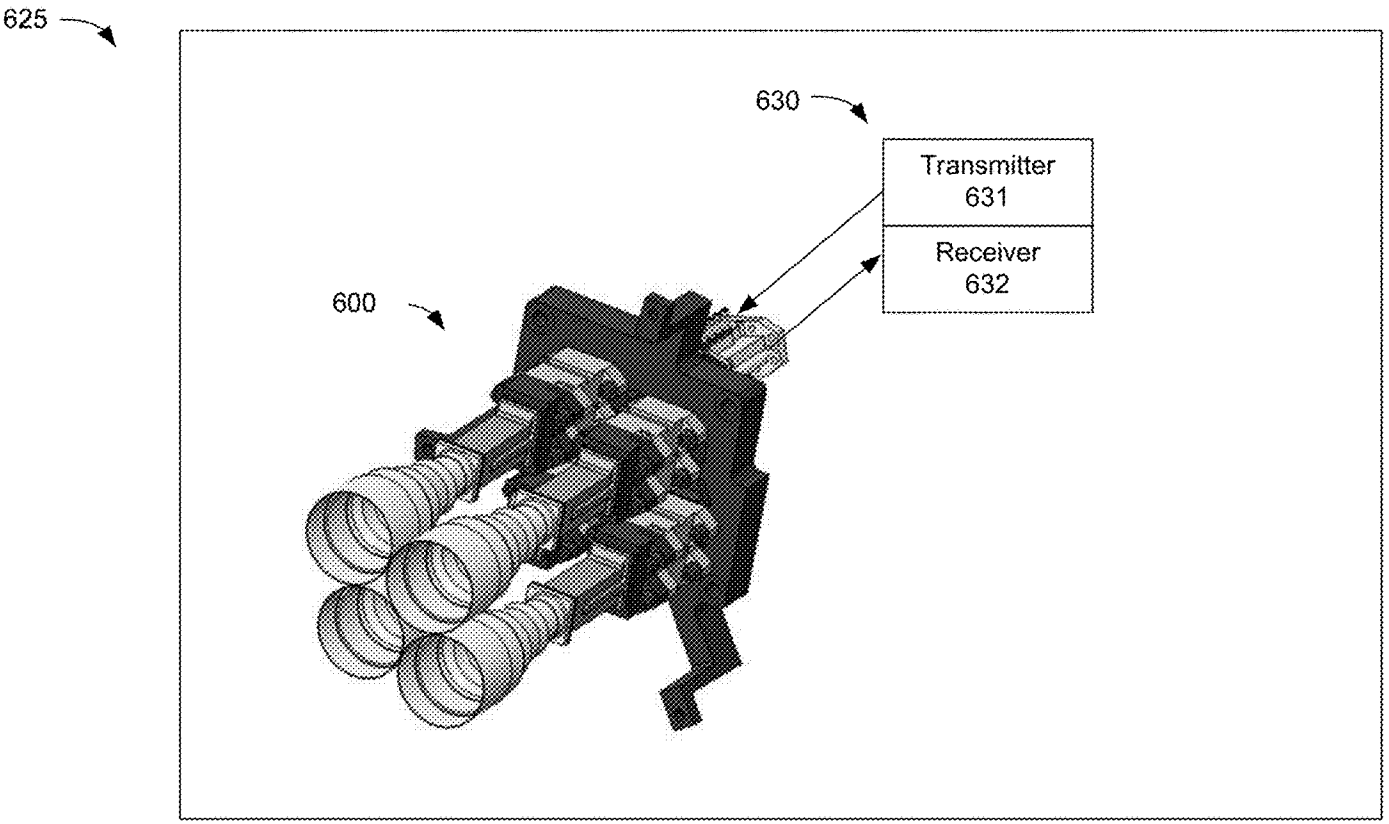
FIG. 6 illustrates a system including dual frequency ReMix BFNs configured to accommodate four radiating elements.

FIG. 6 illustrates a system including dual frequency ReMix beamforming networks configured to accommodate four radiating elements. The system includes a beamforming network 600 that is communicatively coupled with one or both of a transmitter 631 and a receiver 632. The transmitter 631 and the receiver 632 may be components of a communications payload 630 incorporated into a spacecraft 625.

Thus, a Dual-polarized, dual-band, compact beam forming network has been disclosed. The foregoing merely illustrates principles of the invention. It will thus be appreciated that those skilled in the art will be able to devise numerous systems and methods which, although not expressly shown or described herein, embody said principles of the invention and are thus within the spirit and scope of the invention as defined by the following claims.

What is claimed is:

1. An apparatus comprising:

a spacecraft communications payload including a beam forming network (BFN), wherein:

the BFN includes a first feed waveguide and a first set of branch waveguides, each branch waveguide in the first set operating in a frequency band having a first characteristic waveguide wavelength $\lambda_{g1}$;

a proximal portion of the first set of branch waveguides is communicatively coupled with the first feed waveguide;

a distal portion of the first set of branch waveguides is communicatively coupled by way of an array of slots with a plurality of radiating elements; and the array of slots is configured as a honeycomb-like triaxial lattice having three characteristic axes, respective pluralities of slots being aligned with each of the three characteristic axes and a separation distance between adjacent slots in each of the respective pluralities of slots being approximately equal to $\lambda_{g1}$.

2. The apparatus of claim 1, wherein a broadwall of each branch waveguide includes a distal surface and a respective portion of the array of slots is disposed on the distal surface.

3. The apparatus of claim 2, wherein the BFN includes a second feed waveguide and a second set of branch waveguides, each branch waveguide in the second set operating in a frequency band having a second characteristic waveguide wavelength $\lambda_{g2}$;

a proximal portion of the second set of branch waveguides is communicatively coupled with the second feed waveguide;

the first set of branch waveguides is not communicatively coupled with the second feed waveguide;

the second set of branch waveguides is not communicatively coupled with the first feed waveguide;

the array of slots includes a plurality of slot pairs, each slot pair including a respective first slot associated with the first set of branch waveguides and a respective second slot associated with the second set of branch waveguides;

each radiating element is communicatively coupled with a respective one of the plurality of slot pair.

4. The apparatus of claim 3, wherein $\lambda_{g1}$ is approximately equal $\lambda_{g2}$.

5. The apparatus of claim 4, wherein the first feed waveguide and the first set of branch waveguides is configured to operate at a first center frequency and a first polarization scheme; and the second feed waveguide and the second set of branch waveguides is configured to operate at a second center frequency and a second polarization scheme.

6. The apparatus of claim 5, wherein the first polarization scheme is different from the second polarization scheme.

7. The apparatus of claim 5, wherein the first center frequency is different from the second center frequency.

8. The apparatus of claim 3, wherein respective pairs of branch waveguides of the first set of branch waveguides and the second set of branch waveguides are interlaced.

9. The apparatus of claim 8, wherein one or both of a respective orthomode transducer and a respective pair of phase shifters is disposed between each radiating element and each slot pair.

10. The apparatus of claim 8, wherein the first set of branch waveguides is configured to operate at a downlink frequency band and the second set of branch waveguides is configured operate at an uplink frequency band.

11. A system comprising:

a spacecraft communications payload including a receiver, a transmitter, and a beam forming network (BFN), wherein:

the BFN includes a first feed waveguide and a first set of branch waveguides, each branch waveguide in the first set operating in a frequency band having a first characteristic waveguide wavelength $\lambda_{g1}$;

a proximal portion of the first set of branch waveguides is communicatively coupled with the first feed waveguide, the first feed waveguide being communicatively coupled with one or both of the receiver and the transmitter;

a distal portion of the first set of branch waveguides is communicatively coupled by way of an array of slots with a plurality of radiating elements; and the array of slots is configured as a honeycomb-like triaxial lattice having three characteristic axes, respective pluralities of slots being aligned with each of the three characteristic axes and a separation distance between adjacent slots in each of the respective pluralities of slots being approximately equal to $\lambda_{g1}$.

12. The system of claim 11, wherein a broadwall of each branch waveguide includes a distal surface and a respective portion of the array of slots is disposed on the distal surface.

13. The system of claim 12, wherein the BFN includes a second feed waveguide and a second set of branch waveguides, each branch waveguide in the second set operating in a frequency band having a second characteristic waveguide wavelength $\lambda_{g2}$;

a proximal portion of the second set of branch waveguides is communicatively coupled with the second feed waveguide;

the first set of branch waveguides is not communicatively coupled with the second feed waveguide;

the second set of branch waveguides is not communicatively coupled with the first feed waveguide;

the array of slots includes a plurality of slot pairs, each slot pair including a respective first slot associated with the first set of branch waveguides and a respective second slot associated with the second set of branch waveguides;

each radiating element is communicatively coupled with a respective one of the plurality of slot pair.

14. The system of claim 13, wherein $\lambda_{g1}$ is approximately equal $\lambda_{g2}$.

15. The system of claim 14, wherein the first feed waveguide and the first set of branch waveguides is configured to operate at a first center frequency and a first polarization scheme; and the second feed waveguide and the second set of branch waveguides is configured to operate at a second center frequency and a second polarization scheme.

16. An apparatus comprising:

a waveguide slot array including a first feed waveguide and a first set of branch waveguides, each branch waveguide in the first set operating in a frequency band having a first characteristic waveguide wavelength $\lambda_{g1}$; wherein a proximal portion of the first set of branch waveguides is communicatively coupled with the first feed waveguide;

a distal portion of the first set of branch waveguides is communicatively coupled by way of an array of slots with a plurality of radiating elements; and the array of slots is configured as a honeycomb-like triaxial lattice having three characteristic axes, respective pluralities of slots being aligned with each of the three characteristic axes and a separation distance between adjacent slots in each of the respective pluralities of slots being approximately equal to $\lambda_{g1}$.

17. The apparatus of claim 1, wherein a broadwall of each branch waveguide includes a distal surface and a respective portion of the array of slots is disposed on the distal surface.

18. The apparatus of claim 17, wherein the BFN includes a second feed waveguide and a second set of branch waveguides, each branch waveguide in the second set operating in a frequency band having a second characteristic waveguide wavelength $\lambda_{g2}$;

a proximal portion of the second set of branch waveguides is communicatively coupled with the second feed waveguide;

the first set of branch waveguides is not communicatively coupled with the second feed waveguide;

the second set of branch waveguides is not communicatively coupled with the first feed waveguide;

the array of slots includes a plurality of slot pairs, each slot pair including a respective first slot associated with the first set of branch waveguides and a respective second slot associated with the second set of branch waveguides;

each radiating element is communicatively coupled with a respective one of the plurality of slot pair.

19. The apparatus of claim 18, wherein $\lambda_{g1}$ is approximately equal $\lambda_{g2}$.

20. The apparatus of claim 19, wherein respective pairs of branch waveguides of the first set of branch waveguides and the second set of branch waveguides are interlaced.

* * * * *